US010047424B2

(12) United States Patent
Hentschel et al.

(10) Patent No.: US 10,047,424 B2
(45) Date of Patent: Aug. 14, 2018

(54) HIGHLY FORMABLE, MEDIUM-STRENGTH ALUMINIUM ALLOY FOR THE MANUFACTURE OF SEMI-FINISHED PRODUCTS OR COMPONENTS OF MOTOR VEHICLES

(71) Applicants: Thomas Hentschel, Bonn (DE); Simon Miller-Jupp, Worcester (GB); Henk-Jan Brinkman, Bonn (DE); Olaf Engler, Bonn (DE)

(72) Inventors: Thomas Hentschel, Bonn (DE); Simon Miller-Jupp, Worcester (GB); Henk-Jan Brinkman, Bonn (DE); Olaf Engler, Bonn (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 15/270,601

(22) Filed: Sep. 20, 2016

(65) Prior Publication Data

US 2017/0009323 A1 Jan. 12, 2017

Related U.S. Application Data

(63) Continuation of application No. PCT/EP2015/056733, filed on Mar. 27, 2015.

(30) Foreign Application Priority Data

Mar. 28, 2014 (EP) ..... 14162348

(51) Int. Cl.
*C22F 1/043* (2006.01)
*C22C 21/02* (2006.01)
(Continued)

(52) U.S. Cl.
CPC ..... *C22F 1/05* (2013.01); *C22C 21/00* (2013.01); *C22C 21/02* (2013.01); *C22F 1/043* (2013.01); *C22F 1/047* (2013.01)

(58) Field of Classification Search
CPC ..... C22C 21/00–21/18; C22F 1/04–1/057
See application file for complete search history.

(56) References Cited

FOREIGN PATENT DOCUMENTS

| | | | |
|---|---|---|---|
| CA | 2 912 021 | A1 | 12/2014 |
| CN | 101918602 | A | 12/2010 |

(Continued)

OTHER PUBLICATIONS

Zhou Longde et al., China Petrochemical Press, Engineering Materials and Applications, Aug. 31, 2013, 3 pages.

*Primary Examiner* — Lois Zheng
(74) *Attorney, Agent, or Firm* — Reinhart Boerner Van Deuren P.C.

(57) ABSTRACT

An aluminum alloy for the manufacture of semi-finished products or components of motor vehicles, a method for the manufacture of a strip made of an aluminum alloy according to the invention, a corresponding aluminum alloy strip or sheet as well as a structural component of a motor vehicle consisting of an aluminum alloy sheet which includes the following alloy components in % by weight: 0.6%≤Si≤0.9%, 0.6%≤Fe≤1.0%, Cu≤0.1%, 0.6%≤Mn≤0.9%, 0.5%≤Mg≤0.8%, Cr≤0.05%, the remainder Al and impurities, individually up to a maximum of 0.05% by weight, in total up to a maximum of 0.15% by weight.

17 Claims, 2 Drawing Sheets

(51) Int. Cl.

| | |
|---|---|
| ***C22F 1/05*** | (2006.01) |
| ***C22C 21/00*** | (2006.01) |
| ***C22F 1/047*** | (2006.01) |
| *C22F 1/04* | (2006.01) |

(56) References Cited

FOREIGN PATENT DOCUMENTS

| | | | | | |
|---|---|---|---|---|---|
| CN | 101918602 | | * | 7/2012 | ..... C22C 21/02 |
| EP | 2 527 479 | A | | 11/2012 | |
| JP | 07-252611 | A | | 10/1995 | |
| JP | 2002-275566 | A | | 9/2002 | |
| JP | 2002-348626 | A | | 12/2002 | |
| JP | 2006-152359 | A | | 6/2006 | |
| JP | 2007-277706 | A | | 10/2007 | |
| JP | 2008-231475 | A | | 10/2008 | |
| JP | 2012-149354 | A | | 8/2012 | |
| JP | 2013-167004 | A | | 8/2013 | |
| WO | 2014/128212 | A9 | | 8/2014 | |

* cited by examiner

HIGHLY FORMABLE, MEDIUM-STRENGTH ALUMINIUM ALLOY FOR THE MANUFACTURE OF SEMI-FINISHED PRODUCTS OR COMPONENTS OF MOTOR VEHICLES

CROSS-REFERENCE TO RELATED PATENT APPLICATIONS

This patent application is a continuation of PCT/EP2015/056733, filed Mar. 27, 2015, which claims priority to European Application No. 14162348.8, filed Mar. 28, 2014, the entire teachings and disclosure of which are incorporated herein by reference thereto.

FIELD OF THE INVENTION

The invention relates to an aluminium alloy for the manufacture of semi-finished products or components of motor vehicles, a method for the manufacture of a strip made of an aluminium alloy according to the invention, a corresponding aluminium alloy strip or sheet as well as a structural component of a motor vehicle consisting of a sheet of aluminium alloy.

BACKGROUND OF THE INVENTION

Semi-finished products and components for motor vehicles need to meet different requirements depending on the location in which they are used within the motor vehicle and the purpose for which they are used. The forming properties of the aluminium alloy or the strips and sheets are of decisive importance during the manufacture of the semi-finished products and components for motor vehicles. The strength properties, but also in particular the corrosion-resistance properties play an important role during the later use in the motor vehicle.

For example, in the case of structural components of a motor vehicle, for example interior door parts, the mechanical properties are primarily determined through their rigidity, which depends above all on the shape of the interior door parts. In contrast, tensile strength for example has more of a secondary influence. However, the materials used for an interior door part may not be too soft. In contrast, good formability is particularly important for the introduction of aluminium alloy materials in motor vehicle applications, since the components and semi-finished products undergo particularly complex forming processes during manufacture. This applies in particular to components which are manufactured in a single piece as a formed sheet metal shell, for example sheet metal interior door parts with integrated window frame region. By dispensing with joining operations, such components offer significant cost advantages in comparison with, for example, a joined aluminium profile solution for the window frame. The aim is for example to be able to manufacture semi-finished products or components in a single piece of an aluminium alloy, using as few forming operations as possible. This requires an optimization of the forming behaviours of the aluminium alloy which is used. The aluminium alloy of the type AA5005 (AlMg1) occasionally used for similar applications does not fulfill these requirements, since it does not possess sufficient forming capacity due to hardening which takes place during forming.

A further important role is played by corrosion resistance, since components of motor vehicles are frequently exposed to perspiration, condensation and sprayed water. The aluminium alloy which is used must therefore be as corrosion-resistant as possible, in particular resistant to intercrystalline corrosion and filiform corrosion in the painted state. Filiform corrosion is understood to mean a corrosion type which occurs in coated components and which displays a filamentary pattern. Filiform corrosion occurs at high atmospheric humidity in the presence of chloride ions. Although the aluminium alloy of the type AA8006 (AlFe1.5Mn 0.5) exhibits sufficient strength and very high formability, it is susceptible to filiform corrosion. The alloy AA8006 is therefore less suitable for coated, in particular painted components such as interior door parts.

An aluminium alloy is known from the applicant's as yet unpublished patent application PCT/EP2014/053323, as an alternative to the aluminium alloy of the type AA8006, which contains the following alloy components in % by weight:

Fe≤0.8%,
Si≤0.5%,
0.9%≤Mn≤1.5%,
Mg≤0.25%,
Cu≤0.20%,
Cr≤0.05%,
Ti≤0.05%,
V≤0.05%,
Zr≤0.05%, the remainder aluminium, unavoidable accompanying elements individually ≤0.05%, in total ≤0.15%, whereby the total of the Mg and Cu contents fulfils the following relationship:

$$0.15\% \leq Mg+Cu \leq 0.25\%.$$

It has been found that also this aluminium alloy offers scope for improvement, in particular with respect to its forming behaviour. Moreover, the high Mn content leads to problems in recycling this aluminium alloy when it is mixed, in the scrap cycle, with the Al—Mg—Si alloys of the alloy type AA6XXX usually used in automobile applications.

Starting out from this prior art, the present invention is therefore based on the problem of providing an aluminium alloy for the manufacture of semi-finished products or components for motor vehicles which is highly formable, of medium strength and highly corrosion-resistant. In addition, a method for the manufacture of a strip made of a corresponding aluminium alloy, an aluminium strip or sheet, its use and a structural component of a motor vehicle are suggested.

BRIEF SUMMARY OF EMBODIMENTS OF THE INVENTION

According to a first teaching of the present invention, the aforementioned problem is solved through an aluminium alloy for the manufacture of semi-finished products or components of motor vehicles which contains the following alloy components in % by weight:

0.6%≤Si≤0.9%,
0.6%≤Fe≤1.0%,
Cu≤0.1%,
0.6%≤Mn≤0.9%,
0.5%≤Mg≤0.8%,
Cr≤0.05%, the remainder Al and impurities, individually up to a maximum of 0.05% by weight, in total up to a maximum of 0.15% by weight.

Unlike the previous approaches, the present aluminium alloy is based on the knowledge that Al—Mg—Si alloys of the alloy type AA6XXX display very good formability in their soft-annealed state. However, they were too soft for the previous applications. The lower limits of the essential alloy elements of 0.6% by weight for Si, 0.6% by weight for Fe, 0.6% by weight for Mn and 0.5% by weight for Mg guarantee that the aluminium alloy can display sufficient strengths in a soft-annealed state. The upper limits of 0.9% by weight for Si, 1.0% by weight for Fe, 0.9% by weight for Mn and 0.8% by weight for Mg prevent the elongation at break to decrease and to thus adversely affect the forming behaviour. For the same reason, the content of the alloy element Cu is limited to a maximum of 0.1% by weight and that of Cr to a maximum of 0.05% by weight. The combination of the alloy components Si, Fe, Mg and Mn ensures that, on the one hand, the very good forming behaviour of the Al—Mg—Si alloys is combined with an increased strength, without suffering from excessive losses in ductility. Tests showed that the described aluminium alloy in its soft-annealed state fulfills the requirements in terms of formability and in particular corrosion-resistance and is thus suitable for the manufacture of semi-finished products or components in motor vehicles. With the specified ranges of the essential alloy elements Si, Fe, Mn and Mg, the aluminium alloy according to the invention falls into the class of Al—Mg—Si alloys of the alloy type AA6XXX. This makes possible an improved recyclability of this aluminium alloy when it is mixed, in the scrap cycle, with the Al—Mg—Si alloys of the alloy type AA6XXX usually used in automobile applications.

According to a first embodiment of the aluminium alloy according to the invention, the alloy components Si, Fe, Mn and Mg have the following contents in % by weight:

$0.7\% \leq Si \leq 0.9\%$,
$0.7\% \leq Fe \leq 1.0\%$,
$0.7\% \leq Mn \leq 0.9\%$ and
$0.6\% \leq Mg \leq 0.8\%$.

Increasing the lower limits for Si, Fe, Mn and Mg further increases the strength of the aluminium alloy without adversely affecting the forming behaviour or the elongation at break of the soft sheets or strips manufactured from the aluminium alloy.

A further improvement of the aluminium alloy according to the invention in terms of a maximum elongation at break is achieved in that the alloy components Si, Fe, Mn and Mg have the following contents in % by weight:

$0.7\% \leq Si \leq 0.8\%$,
$0.7\% \leq Fe \leq 0.8\%$,
$0.7\% \leq Mn \leq 0.8\%$ and
$0.6\% \leq Mg \leq 0.7\%$.

It has been found that, through this narrow range of essential contents in terms of the alloy components Si, Fe, Mn and Mg, a very good compromise between strength and elongation at break properties, i.e. the forming properties of the aluminium alloy, is achieved.

Although the aluminium alloy according to the invention displays good corrosion-resistant properties, according to a further embodiment of the aluminium alloy the resistance to intercrystalline corrosion can be further improved in that the Si content of the alloy exceeds the Mg content by a maximum of 0.2% by weight, preferably a maximum of 0.1% by weight.

According to a further embodiment of the aluminium alloy according to the invention, the elongation at break of the aluminium alloy can be further improved in that the Cr content is further reduced to a value of maximum 0.01% by weight, preferably to a maximum of 0.001% by weight. It has been found that chromium already has a negative effect on the elongation at break properties in very low concentrations.

The reduction of the Cu content to a maximum of 0.05% by weight, preferably to a maximum of 0.01% by weight, also has a similar effect, whereby at the same time the tendency to filiform corrosion or intercrystalline corrosion is generally reduced through the reduction in the Cu content.

According to a second teaching of the present invention, the aforementioned problem is solved by a method for the manufacture of a strip made of an aluminium alloy according to the invention with the following method steps:

casting of a rolling ingot,
homogenization at a temperature of between 500° C. and 600° C. for at least 0.5 h
hot rolling of the rolling ingot at temperatures of 280° C. to 500° C., preferably at temperatures of 300° C. to 400° C., to a thickness of 3 mm to 12 mm,
cold rolling with or without intermediate annealing with a degree of reduction of at least 50%, preferably at least 70%, to a final thickness of 0.2 mm to 5 mm and
final soft annealing at 300° C. to 400° C., preferably 330° C. to 370° C. for at least 0.5 h, preferably at least 2 h in a chamber furnace.

Following casting, the homogenization at a temperature of 500° C. to 600° C. for at least 0.5 h, preferably at least 2 h ensures that a homogenous structure is provided for the further processing of the rolling ingot. The hot-rolling temperatures thereby make possible a good recrystallisation during the hot rolling, so that the microstructure is as fine-grained as possible after the hot rolling. This fine-grained microstructure is merely elongated by the cold rolling and is recrystallized once again during the final soft-annealing. If produced without intermediate annealing, a particularly high number of displacements are created in the microstructure through the cold rolling which creates a very fine-grained fully recrystallized microstructure during the final soft annealing. For this purpose, the degree of reduction to final thickness before the final soft annealing must be at least 50%, preferably at least 70% in relation to the desired final thickness.

A further positive influence on the fine-grained nature of the microstructure can be achieved in that, according to a further embodiment of the method according to the invention, the homogenization takes place in two stages, whereby the rolling ingot is first heated to 550° C. to 600° C. for at least 0.5 h and then the rolling ingot is kept at 450° C. to 550° for at least 0.5 h, preferably at least 2 h. The rolling ingot is then hot rolled.

The corrosion-resistance properties can be improved in that the rolling ingot is milled on the upper side and underside after casting or after homogenization in order to exclude impurities on the upper side and underside of the rolling ingot which could have a negative influence on corrosion resistance.

According to a further embodiment of the method according to the invention, at least one intermediate annealing takes place, after a first cold rolling, at a temperature of 300° C. to 400° C., preferably at a temperature of 330° C. to 370° C., for at least 0.5 h, whereby before and after the intermediate annealing the degree of reduction amounts to at least 50%, preferably at least 70%. As a result of the chosen degrees of reduction before the intermediate annealing or after the intermediate annealing it is ensured that the microstructure recrystallises sufficiently during the intermediate annealing. The intermediate annealing duration amounts to at least 0.5 h, preferably at least 2 h.

If the intermediate annealing takes place at a temperature of 330° C. to 370° C., due to the increased lower temperature of 330° C. it is ensured that a sufficient recrystallisation takes place and at the same time it is ensured, through the reduction in the upper limit, that an efficient intermediate annealing is carried out which requires as little thermal energy as possible.

According to a third teaching of the present invention, the aforementioned problem is solved by an aluminium alloy strip or sheet manufactured from an aluminium alloy according to the invention, whereby the strip has a thickness of 0.2 mm to 5 mm and in the soft-annealed state has a yield strength $R_{p0.2}$ of at least 45 MPa as well as a uniform elongation $A_g$ of at least 23% and an elongation at break $A_{80\ mm}$ of at least 35%. In particular, with the specified thickness of the strip in combination with the composition of the alloy and the resulting mechanical properties in the soft-annealed state, the prerequisites are fulfilled that the aluminium alloy strip or sheet can be used for components in a motor vehicle, which in addition to very good forming properties also include a very good resistance to intercrystalline corrosion or filiform corrosion. This also applies in particular to painted or coated components.

In this respect, the use of the aluminium alloy strip according to the invention for the manufacture of semi-finished products or components of a motor vehicle, in particular structural components of a motor vehicle, also solves the aforementioned problem. In particular, structural components can be manufactured with very high degrees of deformation and assume very complex forms without requiring particularly complicated forming operations. In particular, these are also particularly corrosion-resistant in painted form, in particular to intercrystalline corrosion and filiform corrosion.

According to a further teaching of the present invention, the aforementioned problem is solved by a structural component of a motor vehicle, in particular an interior door part of a motor vehicle comprising at least one formed sheet of an aluminium alloy according to the invention. As stated above, tests have shown that the aluminium alloy according to the invention not only displays the necessary forming properties in a soft-annealed state but at the same time guarantees the necessary corrosion resistance and strength of the structural components.

In order to achieve the optimum degrees of deformation, the structural component according to the invention is manufactured from a strip which has been produced by means of the method according to the invention. It has been found that, with the method according to the invention, the forming properties as well as the strength properties of the structural components can be achieved in a reliable manner, so that an economical production of the structural components which fulfill the aforementioned prerequisites is possible.

BRIEF DESCRIPTION OF THE SEVERAL VIEWS OF THE DRAWING

The invention is explained in more detail in the following with reference to exemplary embodiments in combination with the drawing. In the drawing.

DETAILED DESCRIPTION OF THE INVENTION

Figure 1:
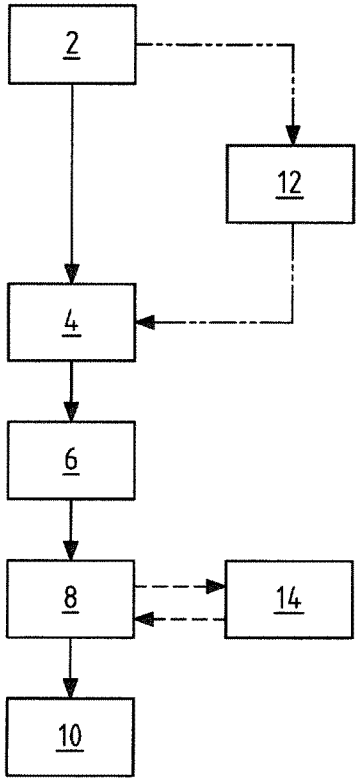
FIG. 1 shows a flow chart of a first exemplary embodiment of the method according to the invention for the manufacture of an aluminium alloy strip.

FIG. 1 shows a first exemplary embodiment in the form of a schematic flow chart. In a first step 2 the rolling ingot is cast, for example using the DC continuous casting method or using the strip casting method. In the method step 4, the ingot is then heated to a temperature of 500° C. to 600° C. and held at this temperature for at least 0.5 h, preferably at least 2 h for homogenization. The rolling ingot homogenized in this way is then hot rolled at a temperature of 280° C. to 500° C., preferably 300° C. to 400° C. to a final thickness of 3 to 12 mm. Then, in the step 8 a cold rolling to final thickness takes place, followed by a recrystallising final soft annealing according to step 10. During the cold rolling to final thickness in one or more passes, the degree of reduction must amount to at least 50%, preferably at least 70%, in order to create a sufficiently fine-grained microstructure during the final soft annealing. The final soft annealing, during which the strip is again recrystallized, takes place in the chamber furnace at 300° C. to 400° C., preferably at 330° C. To 370° C. in step 10. Despite the alloy components of Mg, Si, Fe and Mn according to the invention it is not possible to use a continuous furnace for the manufacture of the aluminium alloy strip according to the invention, since different microstructures would be created due to the different heating and cooling rates.

Alternatively to producing the aluminium alloy strip without intermediate annealing, an intermediate annealing can also be carried out according to step 14 in a chamber furnace at 300° C. to 400° C., preferably at 330° C. to 370° C., whereby a degree of reduction of at least 50%, preferably at least 70%, should be guaranteed both before the intermediate annealing and after the intermediate annealing in order to have a positive effect on the fine-grained nature of the microstructure after the recrystallising final soft annealing. Optionally, after the casting of the rolling ingot in step 2, a milling according to step 12 of the upper side and underside of the rolling ingot can take place in order to minimize the influence of impurities occurring on the edges of the ingot during production of the rolling ingot on the finished product. In particular, this has a positive influence on the corrosion resistance of the components.

Figure 2:
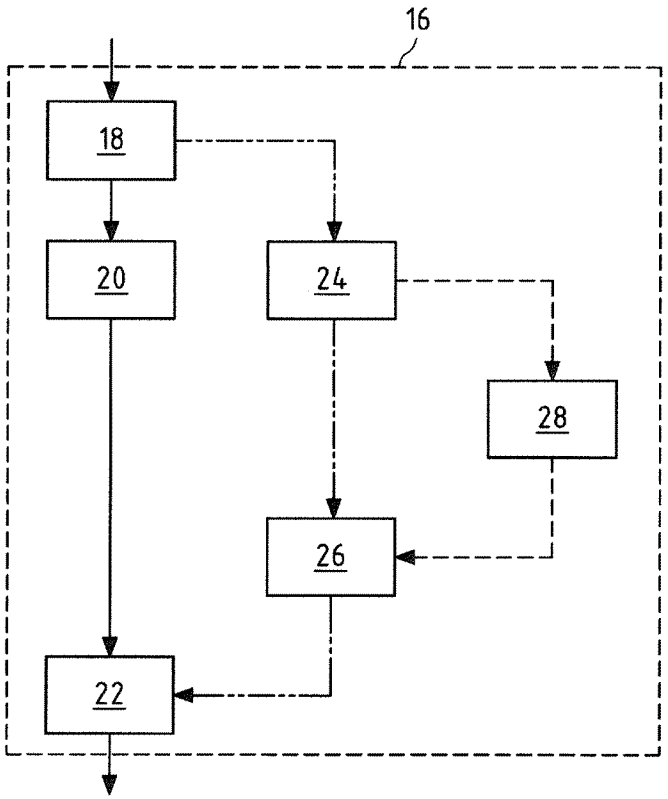
FIG. 2 shows a flow chart for a further exemplary embodiment of the method according to the invention.

FIG. 2 shows a further flow chart which, alternatively to step 4, shows the step 16 of homogenization. The homogenization has an influence on the fine-grained nature of the desired final microstructure of the strip or finished component. In order to further improve the fine-grained nature of the microstructure, the homogenization is carried in multiple stages. Thus, instead of the step 4 in FIG. 1, in FIG. 2 a homogenization step 16 is carried out. The homogenization step 16 first involves a first homogenization phase, step 18, in which the milled or unmilled rolling ingot is heated to a temperature of 550° C. to 600° C. for at least 0.5 h, preferably at least 2 h. In a next step 20 the rolling ingot heated in this way is cooled to a temperature of 450° C. to 550° C. and held at this temperature for at least 0.5 h, preferably at least 2 h, as shown in FIG. 2 in step 22.

Alternatively, after the first homogenization step 18 the rolling ingot can also be cooled to room temperature in a step 24 and, in a following step 26, heated to the temperature for the second homogenization. This is for example necessary if the rolling ingot needs to be stored between the homogenization steps. Optionally, this phase at room temperature can be used to mill the rolling ingot on its upper side and underside, step 28. After the second homogenization step 22 the hot rolling takes place as represented in FIG. 1 with the parameters shown there. It has been found that the multi-stage homogenization, in particular the two-stage homogenization, leads to a finer microstructure in the end product.

The effect according to the invention of providing a medium-strength and very highly formable aluminium alloy or aluminium alloy strip was proved on the basis of 10 exemplary embodiments.

First, 10 different rolling ingots consisting of different alloys were cast using the DC continuous casting method. The upper sides and undersides of the rolling ingots were milled after casting according to step 12. A two-stage homogenization was then carried out in which the rolling ingots were first kept for 3.5 h at 600° C. and then for 2 h at 500° C. Directly following homogenization, the rolling ingots were directly hot rolled at approximately 500° C. into an aluminium alloy hot strip with a thickness of 8 mm. The 8 mm thick hot strip was in each case finally cold-rolled, without intermediate annealing, to a final thickness of 1.5 mm, i.e. with a degree of reduction of more than 70%. The recrystallising final soft annealing of the cold-rolled aluminium alloy strips with a thickness of 1.5 mm took place for 1 h at 350° C. in a chamber furnace. The different tested aluminium alloys are shown in Table 1.

TABLE 1

| Variant | (C): Comparison (I): Invention | Aluminium alloy components in % by weight, Si | Fe | Cu | Mn | Mg | Cr |
|---|---|---|---|---|---|---|---|
| 1 | C | 0.66 | 0.66 | 0.26 | 0.7 | 0.62 | 0.14 |
| 2 | C | 0.53 | 0.46 | 0.19 | 0.52 | 0.44 | 0.13 |
| 3 | C | 0.67 | 0.66 | 0.27 | 0.69 | 0.61 | 0.0005 |
| 4 | C | 0.73 | 0.68 | 0.0016 | 1.0 | 0.67 | 0.0002 |
| 5 | I | 0.72 | 0.69 | 0.0016 | 0.74 | 0.66 | 0.0006 |
| 6 | I | 0.67 | 0.65 | 0.07 | 0.69 | 0.61 | 0.0005 |
| 7 | I | 0.72 | 1.0 | 0.0017 | 0.72 | 0.66 | 0.0004 |
| 8 | I | 0.8 | 0.68 | 0.0015 | 0.72 | 0.63 | 0.0003 |
| 9 | C | 0.4 | 0.41 | 0.004 | 0.47 | 0.41 | 0.001 |
| 10 | C | 0.5 | 0.27 | 0.0013 | 0.66 | 0.42 | 0.0008 |

The variants 1 to 4 as well as 9 and 10 are comparison examples which do not correspond to the aluminium alloy according to the invention. In contrast, the exemplary embodiments 5 to 8 correspond to the aluminium alloy compositions claimed according to the invention.

As well as the yield strength $R_{p0.2}$, the tensile strength $R_m$, the uniform elongation $A_g$, the elongation at break $A_{80\ mm}$ and the SZ 32 cupping in millimeters achieved during stretch forming of cold-rolled aluminium alloy strips produced in this way were measured. The values for the yield strength $R_{p0.2}$ as well as the tensile strength $R_m$ were measured in the tensile test perpendicular to the rolling direction of the sheet according to DIN EN ISO 6892-1:2009. The uniform elongation $A_g$ as well as the elongation at break $A_{80\ mm}$ in percent were measured according to the same standard, in each case perpendicular to the rolling direction of the sheet, using a flat tensile test specimen according to DIN EN ISO 6892-1:2009, Annex B, Form 2. In addition, the forming behaviour can for example be measured in an SZ 32 stretch forming test by means of an Erichsen cupping test (DIN EN ISO 20482), in which a test body is pressed against the sheet, so that a cold deformation occurs. During the cold deformation, the force as well as the punch movement of the test body are measured until a drop in load, caused by the formation of a crack, occurs. In the present exemplary embodiments, the cupping test was carried out with a stamping head diameter of 32 mm, matched to the thickness of the sheet and a die diameter of 35.4 mm, using a Teflon drawing foil to reduce friction. An overview of the results is provided in Table 2.

TABLE 2

| Variant | (C): Comparison (I): Invention | $R_{p0.2}$ N/mm$^2$ | $R_m$ N/mm$^2$ | $A_g$ % | $A_{80\ mm}$ % | SZ32 mm |
|---|---|---|---|---|---|---|
| 1 | C | 65 | 145 | 19.6 | 26.5 | 15.8 |
| 2 | C | 52 | 131 | 21.9 | 30.3 | 16.2 |
| 3 | C | 60 | 135 | 22.7 | 30.3 | 16.4 |
| 4 | C | 51 | 122 | 22.3 | 33.5 | 15.6 |
| 5 | I | 48 | 112 | 23.1 | 35.3 | 16.0 |
| 6 | I | 47 | 118 | 23.5 | 35.0 | 16.5 |
| 7 | I | 50 | 120 | 23.4 | 36.2 | 16.1 |
| 8 | I | 47 | 112 | 23.8 | 36.6 | 15.0 |
| 9 | C | 41 | 98 | 23.6 | 37.9 | 16.5 |
| 10 | C | 41 | 102 | 24.2 | 38.0 | 16.3 |

Comparing the variant 2 for example with the variants 5 to 8 according to the invention, the exemplary embodiments show that too great a reduction in the content of Si, Fe, Mn, Mg combined with an increase in the content of Cu and Cr means that, while the yield strength values remain above 45 MPa, the elongation at break is reduced significantly to around 30%. This effect can be proved if the Mn content alone amounts for example to 1.0%, which already reduces the elongation at break $A_{80\ mm}$ to below 35%, variant 4. The variants 9 and 10 show the effect of reduced contents of Si, Fe, Mn and Mg. While the comparison examples 9 and 10 display a very good elongation at break $A_{80\ mm}$, with more than 35%, the yield strength is, at 41 MPa, below that of the exemplary embodiments 5 to 8 according to the invention.

The exemplary embodiments according to the invention displayed very good forming behaviour, in particular under high degrees of deformation, which can be seen from the very good SZ 32 stretch forming results and the high elongation values both for uniform elongation $A_g$ as well as the elongation at break $A_{80\ mm}$.

These results show that, overall, the critical factor is the interrelationship between the alloy contents of Si, Fe, Mn, Mg, whereby the contents of the components Cr and Cu must be kept particularly low; preferably, the Cu content is ≤0.05% by weight, preferably ≤0.01% by weight and the chrome content is ≤0.01% by weight, preferably ≤0.001% by weight. Coupled with the very good corrosion-resistance of the exemplary embodiments, semi-finished products and components for vehicles, in particular structural components such as interior door parts, can be provided which not only meet the specifications required within this field of application in terms of mechanical and chemical properties, but can also be manufactured economically using few forming operations.

Figure 3:
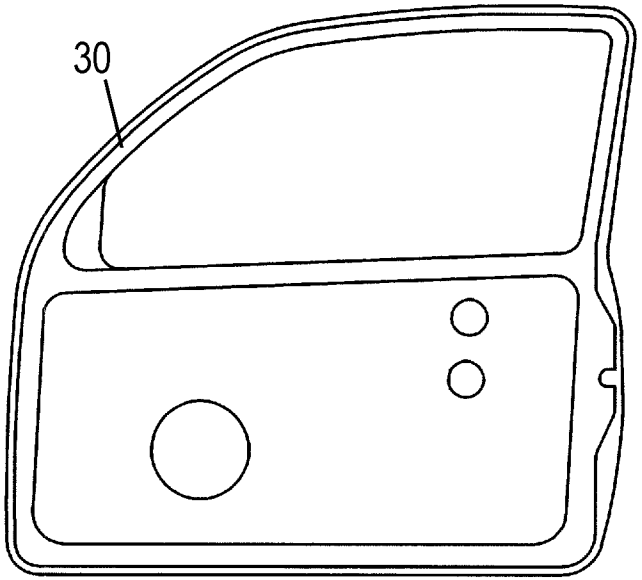
FIG. 3 shows a diagrammatic representation of an exemplary embodiment of a structural component of a motor vehicle.

The aluminium alloy strips produced according to the invention are therefore ideally suitable for providing, for example, structural components of a motor vehicle, such as the interior door parts 30 illustrated in FIG. 3, or for use in their manufacture. The interior door part is manufactured from a sheet of an aluminium alloy according to the invention with a thickness of 1.5 mm which provides a window frame simply through forming operations, but without joining operations.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An aluminium alloy for the manufacture of semi-finished products or components of motor vehicles, which comprises the following alloy components in % by weight:
0.7%≤Si≤0.9%,
0.7%≤Fe≤1.0%,
Cu≤0.05%,
0.7%≤Mn≤0.9%,
0.6%≤Mg≤0.8%,
Cr≤0.05%,
the remainder Al and impurities, individually up to a maximum of 0.05% by weight,
in total up to a maximum of 0.15% by weight.

2. The aluminium alloy according to claim 1, characterised in that the alloy components Si, Fe, Mn and Mg have the following contents in % by weight:
0.7%≤Si≤0.8%,
0.7%≤Fe≤0.8%,
0.7%≤Mn≤0.8% and
0.6%≤Mg≤0.7%.

3. The aluminium alloy according to claim 1, characterised in that the aluminium alloy has the following Cr content in % by weight:
Cr≤0.01%.

4. The aluminium alloy according to claim 1, characterised in that the aluminium alloy has the following Cu content in % by weight:
Cu≤0.01%.

5. An aluminum alloy strip or sheet manufactured of an aluminum alloy characterized in that the aluminum alloy comprises the following alloy components in % by weight:
0.6%≤Si≤0.9%,
0.6%≤Fe≤1.0%,
Cu≤0.05%,
0.6%≤Mn≤0.9%,
0.5%≤Mg≤0.8%,
Cr≤0.05%,
the remainder A1 and impurities, individually up to a maximum of 0.05% by weight, in total up to a maximum of 0.15% by weight,
the strip has a thickness of 0.2 mm to 5 mm and in a soft-annealed state has a yield strength $R_{p0.2}$ of at least 45 MPa and an elongation at break $A_{80\ mm}$ of at least 35%.

6. The aluminium alloy strip according to claim 5, wherein the strip is used for the manufacture of semi-finished products or components for motor vehicles.

7. The aluminium alloy strip according to claim 6, wherein the components for motor vehicles is a structural component of a motor vehicle.

8. A structural component, comprising at least one formed sheet of an aluminium alloy, wherein the aluminium alloy comprises the following alloy components in % by weight:
0.6%≤Si≤0.9%,
0.6%≤Fe≤1.0%,
Cu≤0.05%,
0.6%≤Mn≤0.9%,
0.5%≤Mg≤0.8%,
Cr≤0.05%,
the remainder Al and impurities, individually up to a maximum of 0.05% by weight,
in total up to a maximum of 0.15% by weight and the sheet is cut from a strip according to claim 5.

9. The structural component of claim 8, wherein the structural component is an interior door part of a motor vehicle.

10. A method for the manufacture of an aluminum alloy strip or sheet of claim 5
with following method steps:
casting of a rolling ingot,
homogenization at a temperature of between 500° C. and 600° C. for at least 0.5 h,
hot rolling of the rolling ingot at temperatures of 280° C. to 500° C. to a thickness of 3 mm to 12 mm,
cold rolling with or without intermediate annealing with a degree of reduction of at least 50%, preferably at least 70% to a final thickness of 0.2 mm to 5 mm and
final soft annealing at 300° C. to 400° C. for at least 0.5 h in a chamber furnace.

11. The method according to claim 10, characterised in that the alloy components Si, Fe, Mn and Mg have the following contents in % by weight:
0.7%≤Si≤0.8%,
0.7%≤Fe≤0.8%,
0.7%≤Mn≤0.8% and
0.6%≤Mg≤0.7%.

12. The method according to claim 10, characterised in that the aluminium alloy has the following Cr content in % by weight:
Cr≤0.01%.

13. The method according to claim 10, characterised in that the aluminium alloy has the following Cu content in % by weight:

Cu≤0.01%.

14. The method according to claim 10, characterised in that the homogenisation takes place in at least two stages, wherein the rolling ingot is first heated to 550° C. to 600° C. for at least 0.5 h and then the rolling ingot is cooled to 450° C. to 550° C., held at this temperature for at least 0.5 h and then hot-rolled.

15. The method according to claim 10, characterised in that the rolling ingot is milled on the upper side and underside after casting or after homogenisation.

16. The method according to claim 10, characterised in that an intermediate annealing takes place, after a first cold rolling, at a temperature of 300° C. to 400° C. for at least 0.5 h, wherein the degree of reduction amounts to at least 50%, preferably at least 70%, before and after the intermediate annealing.

17. The method according to claim 10, characterised in that the intermediate annealing is carried out at a temperature of 330° C. to 370° C.

* * * * *